United States Patent [19]

Frei

[11] 4,389,964

[45] Jun. 28, 1983

[54] APPARATUS FOR APPLYING A PROTECTIVE COATING TO THE SEAM OF WELDED CAN SLEEVES

[75] Inventor: Siegfried Frei, St. Gallen, Switzerland

[73] Assignee: Frei AG Maschinenbau, Wittenbach, Switzerland

[21] Appl. No.: 322,235

[22] Filed: Nov. 17, 1981

[30] Foreign Application Priority Data

Dec. 3, 1980 [CH] Switzerland ..... 8916/80
May 6, 1981 [CH] Switzerland ..... 2942/81

[51] Int. Cl.[3] ..... B05C 1/02; B05C 7/08

[52] U.S. Cl. ..... 118/66; 118/69; 118/203; 118/215; 118/245; 118/73; 118/223

[58] Field of Search ..... 118/203, 204, 215, 245, 118/262, 69, 73, 66, 223

[56] References Cited

U.S. PATENT DOCUMENTS 1,549,576 8/1925 Labombard et al. ..... 118/262
3,335,696 8/1967 Faltin et al. ..... 118/245 X
3,813,260 5/1974 Lipstein ..... 118/69 X
4,249,476 2/1981 Opprecht et al. ..... 118/204

*Primary Examiner*—John P. McIntosh
*Attorney, Agent, or Firm*—Erwin S. Teltscher

[57] ABSTRACT

In an apparatus for applying a protective substance to a welding seam of a metallic sleeve, including a frame, a container disposed within the frame holding a protective substance, a drivable applicator roller disposed in the container at least in part contact with the protective substance and applying the protective substance to the seam of the metallic sleeve within a substance transfer region, and wherein the sleeve moves towards, past and away from the applicator roller, comprising in combination therewith, a stripper disposed within the transfer region on each side of the seam removing any excess substance leaking away laterally from the seam.

16 Claims, 4 Drawing Figures

APPARATUS FOR APPLYING A PROTECTIVE COATING TO THE SEAM OF WELDED CAN SLEEVES

BACKGROUND OF THE INVENTION

The present invention relates to an apparatus for applying a protective substance to a welding seam of a metallic sleeve, including a frame, a container disposed within the frame holding a protective substance, and a drivable applicator roller disposed in the container at least in part contact with the protective substance and applying it to the seam of the metallic sleeve.

In Swiss Pat. No. 624,591 there is described an apparatus for applying a protective layer to the seam of a can component, for example a sleeve. Lacquer is applied to the seam from the periphery of a driven disc-shaped roller partially dipping into a container containing the lacquer, and wherein lacquer is also applied to regions disposed on each side of the seam. In order for the bulge-like seam to be reliably covered, more lacquer is fed from the periphery of the roller to the seam than can be received by the seam. Within a contact region of the periphery of the roller with the sleeve, any excess lacquer is pressed outwardly from the seam and forms on each side of the coated seam a bulging coating.

In a drying process which follows, bubbles may form in the bulging coating and may result in an impaired coating due to an imperfect drying process.

Furhermore, the visual impression of the seam covered with the coating is poor and consumption of the lacquer increased.

SUMMARY OF THE INVENTION

One of the principal objects of the invention is to create an apparatus, which prevents lateral formation of bulges or protuberances on each side of the strip-like seam, and where the seam can be covered with a coating which is qualitatively and visually excellent.

It is a further object of the present invention to increase the quality of the coating by suitable measures before and during the lacquering process.

These objects are attained, according to the invention, in an apparatus for applying a protective substance to a welding seam of a metallic sleeve, including a frame, a container disposed within the frame holding a protective substance, a drivable applicator roller disposed in the container at least in part contact with the protective substance and applying the protective substance to the seam of the metallic sleeve within a substance transfer region, and wherein the sleeve moves towards, past, and away from the applicator roller which comprises, in combination therewith, stripping means disposed within the transfer region on each side of the seam, so as to remove any excess substance leaking away laterally from the seam.

BRIEF DESCRIPTION OF THE DRAWINGS

For a fuller understanding of the nature and objects of the invention, reference should be had to the following detailed description, taken in connection with the accompanying drawings in which.

DESCRIPTION OF THE PREFERRED EMBODIMENT

Figure 1:
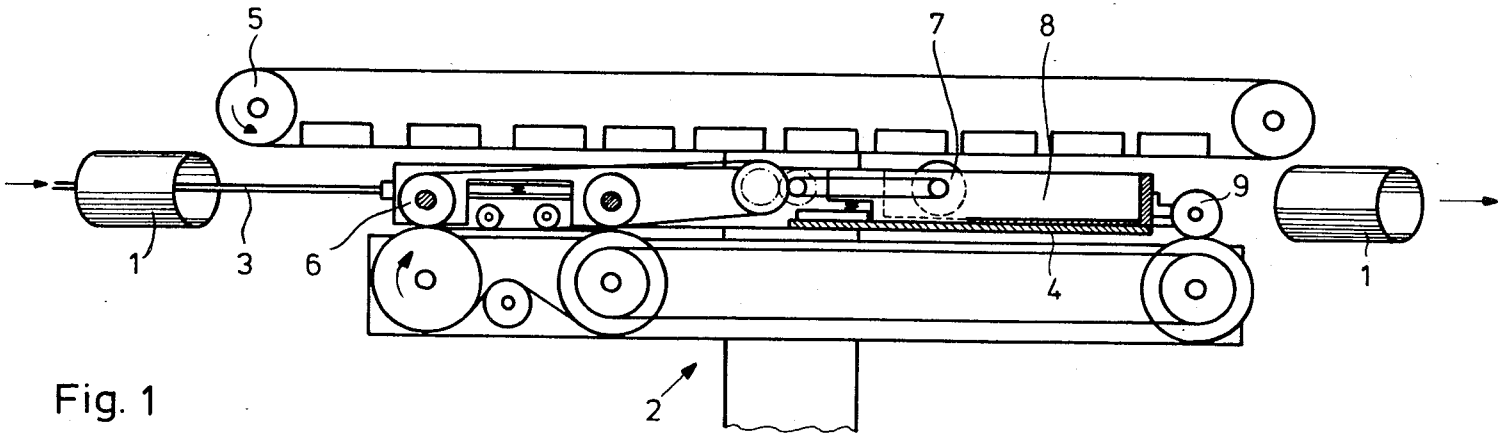
FIG. 1 is an elevational view of an apparatus of the prior art.
Figure 2:
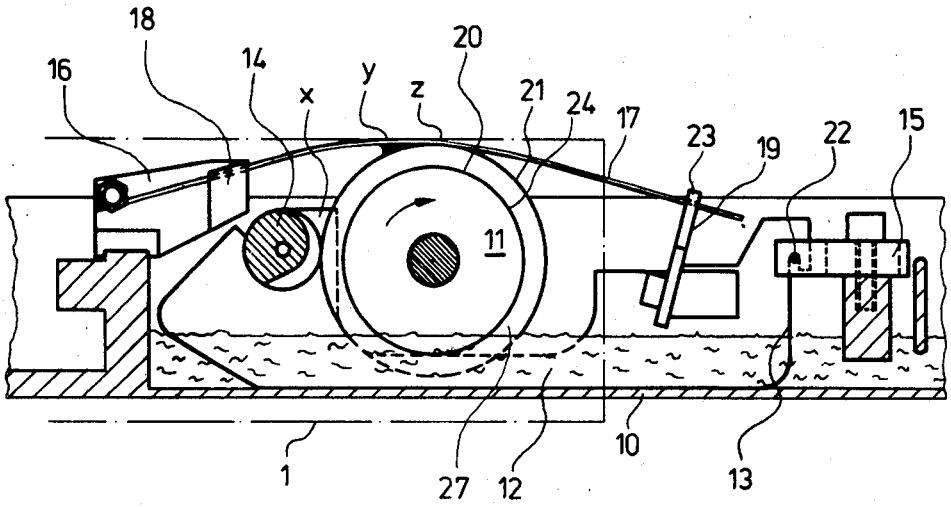
FIG. 2 is a large-scale section through an apparatus of the present invention.
Figure 3:
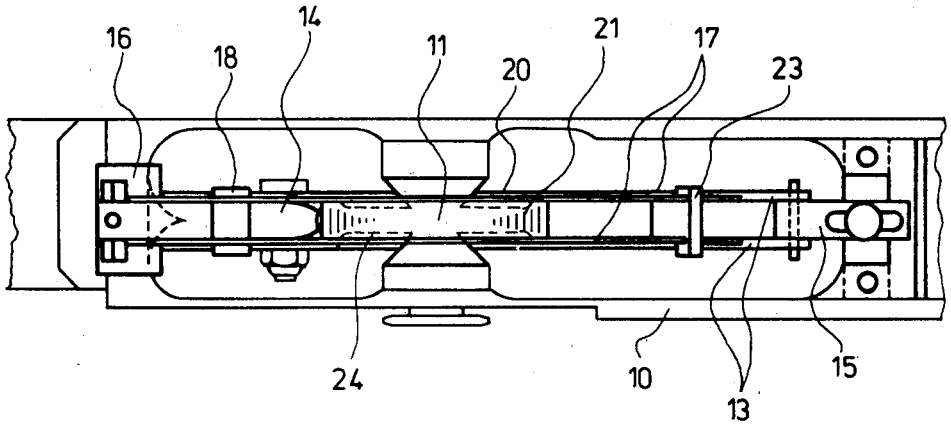
FIG. 3 is a plan view of the apparatus of the present invention corresponding to FIG. 2.

For an easier understanding of the invention, there is shown in FIG. 1 an elevational view of an apparatus of the prior art, which can be retrofitted with the invention device as shown in FIGS. 2 and 3.

As seen, therefore, in FIG. 1, there are fed from a (non-illustrated) welding machine from the left welded sleeves 1 having a seam in a known manner to the lacquering apparatus 2. The lacquering device 4 is disposed on a tube 3, which is also connected to the welding machine, and also includes a lacquer feeding device. The lacquering device 4, which is successively surrounded by the sleeves 1 passing from left to right, and wherein the sleeves 1 are transported from left to right by a magnetic transport system 5, includes as key elements a driving member 6 for an applicator roller 7, a container 8 receiving the lacquer, which accommodates the roller 7, as well as an abutment roller 9.

In FIGS. 2 and 3 there is shown a lacquering device 10, which can be substituted for the lacquering device 4 in the lacquering apparatus 2. There is provided, in a known manner, a drivable applicator roll 11, which is at least in part in contact with a protective substance such as a lacquer 12. The container holding the lacquer is formed, for example, by sheet metal portions 13 partly surrounding the applicator roller 11, in which container there is also disposed an eccentric cam 14 which has a cam surface spaced from the applicator roller 11 at a predetermined adjustable distance and cooperating therewith; the distance separating the cam surface of the cam 14 from the applicator roller 11 can be adjusted in a simple manner by suitably turning the eccentric cam 14 about a cam axis which is, however, spaced at a fixed distance from the applicator roller 11. The container composed of sheet metal pieces 13 can be pivoted around a pivoting point 22. On the front portion of the device, as defined in the direction of movement of the sleeves 1, there are disposed holding means 16 which hold stripping means 17, implemented, for example by wires, as shown in FIG. 2. When the stripping means 17 are implemented by elastic longitudinal strips of wires, the strips are laterally guided by being disposed in respective slits 18 formed in the holding means 16. The resilient strips of wires are installed in the holding means 16 by being guided thereinto from above. In the container 13 there is additionally provided another holding means 23, formed with two slits 19 open at their lower ends. Within these slits 19 there are disposed the stripping means 17 in the form of the longitudinal strips and are thereby forced to assume an arcuate shape. The longitudinal strips 17 abut resiliently the periphery of the applicator roller 11. The crown y of the arcuate stripping means 17 is preferably disposed ahead of the region z where the stripping means 17 abut the sleeve 1, shown dash-dotted in FIG. 2.

In a further embodiment of the invention, the applicator roller 11 is provided with an annular recess 24 on each side thereof, so as to give rise to the formation of an annular peripheral region 27. Both longitudinal strips or wires 17 are disposed within the region 27.

In certain applications, for example, in the case of chemically corrosive materials, it may not be sufficient to apply the lacquer 12 directly to the naked seam, as the welded seam has sharp edges, so that it is difficult to apply the lacquer 12 at a suitable thickness to such thin edges, resulting in an imperfect coating.

Figure 4:
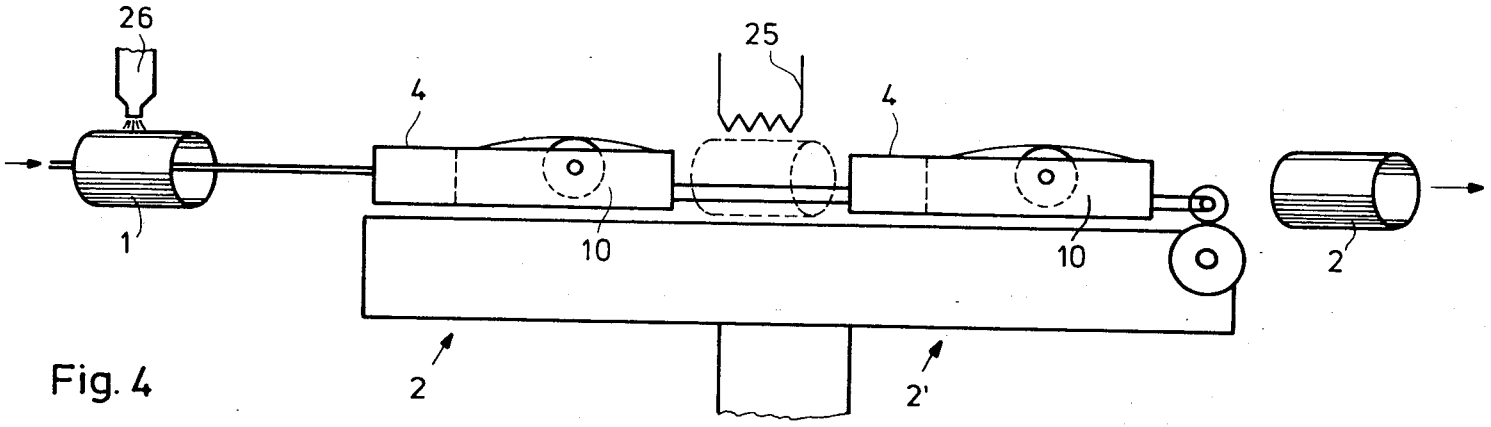
FIG. 4 is a schematic elevational view of two apparatuses according to the present invention connected in series.

In such a case, two devices 2 and 2' are connected in series. The first apparatus 2 applies a primer to the sleeve, and the second apparatus 2' applies a covering layer to the sleeve coated with the primer. In some cases it is advantageous to provide heating means, such as a heater 25 between the devices 2 and 2'. The two devices 2 and 2' connected in series with a heater 25 disposed therebetween can also be retrofitted to the lacquering apparatus 2 shown in FIG. 1. In dependence of the composition of the lacquer 12 and the primer, the heated seam may be cooled by cooling means before the primer is applied; this can be accomplished by means of a nozzle 26, as shown in FIG. 4, which is disposed ahead of the lacquering apparatus 2 as seen in the direction of movement of the sleeve 1, but behind the welding machine. This is best seen in the schematic representation of FIG. 4. In other cases it may be advantageous to heat or dry the primer prior to the application of a covering lacquer 12 by the heater 25.

In a further advantageous implementation of the invention a paste of relatively high viscosity can be applied to the sleeve 1 by the lacquering apparatus 2, and a paste of relatively low viscosity for the purpose of sealing or covering the coated sleeve can be applied to the sleeve by the apparatus 2'.

The roller 11 may also apply a cooling fluid, for example, Dianol to the seam instead of a primer, so as to cool the seam and in this way minimize any loss of the applied lacquer.

During operation the driven applicator roller 11 carries on its periphery 21 the lacquer 12 which in turn passes the eccentric cam 14. Based on the adjusted distance x a uniform and continuous amount of lacquer is carried up to the lacquer transfer region ahead of the crown z of the roller 11, and therefrom to the seam of the sleeve 1 and neighboring regions thereof. In order to ensure an adequate covering of the uneven seam, an excess amount of lacquer 12 must be supplied from the roller periphery 21 to the seam of the sleeve 1. Any excess of lacquer 12 is displaced outwardly within the transfer region to the sides 20 of the roller 11 by the stripping means in the form of the longitudinal strips 17. Any deposition of any excess lacquer in the form of longitudinal bulges along or next to the coated seam of the sleeve 1 is therefore reliably prevented.

As a result of the displacement of the holding means 23 the top position y of the longitudinal strips 17 can be tailored to the prevailing conditions, such as diameter of the sleeve or its curvature, properties of the metal sheet, properties of the lacquer, velocity of application of the lacquer and the like.

The present invention has a number of considerable advantages which can be obtained at small expense and great effectiveness:

although an excess lacquer is supplied, a coating of low thickness is obtained;

formation of technologically undesired lateral bulges is prevented;

the elasticity of the inventive device ensures reliable operation even under changing conditions;

as a result of its simple construction the device can be taken apart in a simple manner for daily cleaning;

retrofit into existing lacquering devices can be accomplished easily at a relatively low cost;

by cooling prior to application of lacquer any tendency of the lacquer not to adhere to the seam is reduced; and the covering consisting of two layers ensures optimal protection as far as corrosion of the seam is concerned in the presence of corrosive materials.

I wish it to be understood that I do not desire to be limited to the exact details of construction shown and described, for obvious modifications will occur to a person skilled in the art.

Having thus described the invention, what I claim as new and desired to be secured by letters patent is as follows:

1. In an apparatus for applying a protective substance to a welding seam of a metallic sleeve, including a frame, a container disposed within said frame holding a protective substance, a drivable applicator roller disposed in said container at least in part contact with said protective substance and applying the protective substance to the seam of said metallic sleeve within a substance transfer region, and wherein said sleeve moves towards, past and away from said applicator roller.

comprising in combination therewith stripping means disposed within said transfer region abutting the periphery of said applicator roller and adapted for removing any excess substance leaking away laterally from said seam.

2. An apparatus as claimed in claim 1, wherein said protective substance is a lacquer, and wherein said stripping means includes a plurality of longitudinal strips resiliently abutting the periphery of said applicator roller thereby exerting pressure on said applicator roller-,and said seam in a direction to displace any excess lacquer therefrom.

3. An apparatus as claimed in claim 2, wherein said longitudinal strips are steel wires.

4. An apparatus as claimed in claim 2, further comprising a rotatable eccentric cam having a cam surface spaced from said applicator roller at a predetermined adjustable distance and cooperating therewith, while having a cam axis spaced at a fixed distance from said applicator roller, and wherein the amount of the lacquer applied to the seam of said sleeve may be varied by turning said cam about said cam axis by a predetermined angle, thereby adjusting said distance.

5. An apparatus as claimed in claim 2, wherein said stripping means is arcuately shaped, and further comprising holding means having a plurality of slits connecting said stripping means to said frame, thereby stabilizing said stripping means and providing lateral guidance thereto.

6. An apparatus as claimed in claim 1, wherein said stripping means is connected to said frame and subtends an arc, the crown of which resiliently abuts said sleeve interiorly.

7. An apparatus as claimed in claim 6, wherein said applicator roller has a predetermined direction of rotation, and the crown of said arcuate stripping means is disposed ahead of the region where said stripping means abuts said sleeve, as seen in said direction of rotation.

8. An apparatus as claimed in claim 1, wherein said stripping means is connected with one end thereof to said frame.

9. An apparatus as claimed in claim 1, wherein said stripping means is arcuately shaped and connected at two holding means thereof to said frame, at least one of said holding means being displaceable within said frame, and the arcuate shape of said stripping means being adjustable by displacement of said one of said holding means.

10. An apparatus as claimed in claim 1, wherein said applicator roller is provided with an annular recess on each side thereof.

11. An apparatus as claimed in claim 1, further comprising a second apparatus similar to, and connected in series with the first apparatus, and heating means disposed between said apparatuses, whereby a first protective substance may be applied by said first apparatus to the seam of said sleeve and upon heating of the first protective substance resulting in said seam being coated onto said sleeve, a second protective substance may be applied to the coated seam.

12. An apparatus as claimed in claim 11, wherein the substance applied by said first apparatus is a primer, and the substance applied by said second apparatus is a covering layer covering the seam of said sleeve.

13. An apparatus as claimed in claim 11, wherein the protective substance received by the container of the first apparatus is a paste of relatively high viscosity, and the protective substance received by the container of the second apparatus is a paste of relatively low viscosity.

14. An apparatus as claimed in claim 11, wherein the protective substance received by the container of the first apparatus is a cooling substance.

15. An apparatus as claimed in claim 1, further comprising cooling means disposed ahead of the applicator roller of the first apparatus, as seen in the direction of transport of said sleeve, whereby the seam of said sleeve can be cooled prior to the protective substance being applied thereto.

16. An apparatus as claimed in claim 15, wherein said cooling means includes a nozzle arranged to blow gas consisting of the group of cold air and carbon dioxide onto the seam of said sleeve.

* * * * *